US008632112B2

(12) United States Patent
Kim et al.

(10) Patent No.: US 8,632,112 B2
(45) Date of Patent: Jan. 21, 2014

(54) WORKPIECE DISPLACEMENT SYSTEM

(75) Inventors: Hyunjoo Kim, Seoul (KR); Hunki Lee, Seoul (KR); Changyong Lee, Seoul (KR); Jong Wook Ju, Bubal-eub Icheon-Si (KR); Sang-Ho Lee, Kyounggi (KR)

(73) Assignee: Stats Chippac Ltd., Singapore (SG)

( * ) Notice: Subject to any disclaimer, the term of this patent is extended or adjusted under 35 U.S.C. 154(b) by 1230 days.

(21) Appl. No.: 11/465,769

(22) Filed: Aug. 18, 2006

(65) Prior Publication Data

US 2008/0066511 A1 Mar. 20, 2008

(51) Int. Cl.
*B25J 15/06* (2006.01)

(52) U.S. Cl.
USPC ..... 294/183; 294/189

(58) Field of Classification Search
USPC ..... 294/64.1, 65, 183, 189; 901/40; 29/743; 269/21
See application file for complete search history.

(56) References Cited

U.S. PATENT DOCUMENTS

| | | | | | |
|---|---|---|---|---|---|
| 3,377,096 | A * | 4/1968 | Wood | 294/64.1 |
| 4,529,353 | A * | 7/1985 | Dean et al. | 414/810 |
| 4,600,228 | A * | 7/1986 | Tarbuck | 294/189 |
| 5,029,383 | A * | 7/1991 | Snyder et al. | 29/740 |
| 5,169,196 | A * | 12/1992 | Safabakhsh | 294/64.3 |
| 6,135,522 | A * | 10/2000 | Su et al. | 294/64.1 |
| 6,254,155 | B1 * | 7/2001 | Kassir | 294/64.1 |
| 6,364,386 | B1 * | 4/2002 | Quick et al. | 294/64.1 |
| 7,055,875 | B2 * | 6/2006 | Bonora et al. | 294/64.1 |
| 2005/0110292 | A1 * | 5/2005 | Baumann et al. | 294/64.1 |
| 2005/0221582 | A1 | 10/2005 | Lee et al. | |

FOREIGN PATENT DOCUMENTS

| | | |
|---|---|---|
| JP | 11288997 | 10/1999 |
| JP | 2002246420 | 8/2002 |

* cited by examiner

*Primary Examiner* — Dean Kramer
(74) *Attorney, Agent, or Firm* — Ishimaru & Associates LLP

(57) ABSTRACT

A method of operation of a workpiece displacement system includes: providing a head including a conduit, a recess port, and a channel, the conduit configured such that its major axis intersects the recess port and the channel; inserting a force distribution member into the recess port; and supplying a negative pressure state through the head and the force distribution member.

19 Claims, 6 Drawing Sheets

WORKPIECE DISPLACEMENT SYSTEM

TECHNICAL FIELD

The present invention relates generally to a workpiece displacement system, and more particularly to a workpiece displacement system for integrated circuits.

BACKGROUND ART

At the completion of the wafer fabrication process, wafers that pass electrical test are ready for assembly and packaging of the individual semiconductor chips. These semiconductor chips may include integrated circuit systems that find application in many of today's consumer electronic devices, such as cellphones, video cameras, portable music players, computers, etc.

Traditionally, the back-end assembly of the integrated circuit process separates each good semiconductor chip or integrated circuit system from the wafer and attaches them to a metal leadframe or substrate via an automated die bonder. The automated die bonder is a commonly employed high-speed tool that uses a special gripper, referred to as a collet, to pick up each semiconductor chip and place them on the leadframe or substrate for assembly. These die bonder tools require great flexibility to attach a multitude of chips of varying size and dimensions to a variety of applications involving various configurations and electrical contact schemes.

Unfortunately, many conventional die bonding tools suffer from loose adhesion and size mismatch between a head portion of the die bonder tool and a suction portion of the die bonder tool. This loose adhesion and size mismatch between the head portion and the suction portion can lead to failure during operation of the die bonder. Additionally, many die bonding tools exert an uneven bonding force upon their desired target (i.e.—a semiconductor chip). The uneven bonding force exerted by conventional die bonding tools can lead to chip attach failure due to the formation of a void between the chip being placed and an underlying chip or substrate. Furthermore, many die bonding tools lack the ability to seamlessly integrate semiconductor chips of various sizes because of the necessary re-tool modifications to the head portion and the suction portion to accommodate such varying sizes.

Thus, a need still remains for a die bonding tool that is reliable, prevents chip attach failure, and that can be easily reconfigured to accommodate semiconductor chips of various sizes. In view of the ever increasing commercial competitive pressures, increasing consumer expectations, and diminishing opportunities for meaningful product differentiation in the marketplace, it is increasingly critical that answers be found to these problems. Moreover, the ever-increasing need to save costs, improve efficiencies, and meet such competitive pressures adds even greater urgency to the critical necessity that answers be found to these problems.

Solutions to these problems have been long sought but prior developments have not taught or suggested any solutions and, thus, solutions to these problems have long eluded those skilled in the art.

DISCLOSURE OF THE INVENTION

The present invention provides a method of operation of a workpiece displacement system including: providing a head including a conduit, a recess port, and a channel, the conduit configured such that its major axis intersects the recess port and the channel; inserting a force distribution member into the recess port; and supplying a negative pressure state through the head and the force distribution member.

Certain embodiments of the invention have other aspects in addition to or in place of those mentioned above. The aspects will become apparent to those skilled in the art from a reading of the following detailed description when taken with reference to the accompanying drawings.

BEST MODE FOR CARRYING OUT THE INVENTION

Figure 1:
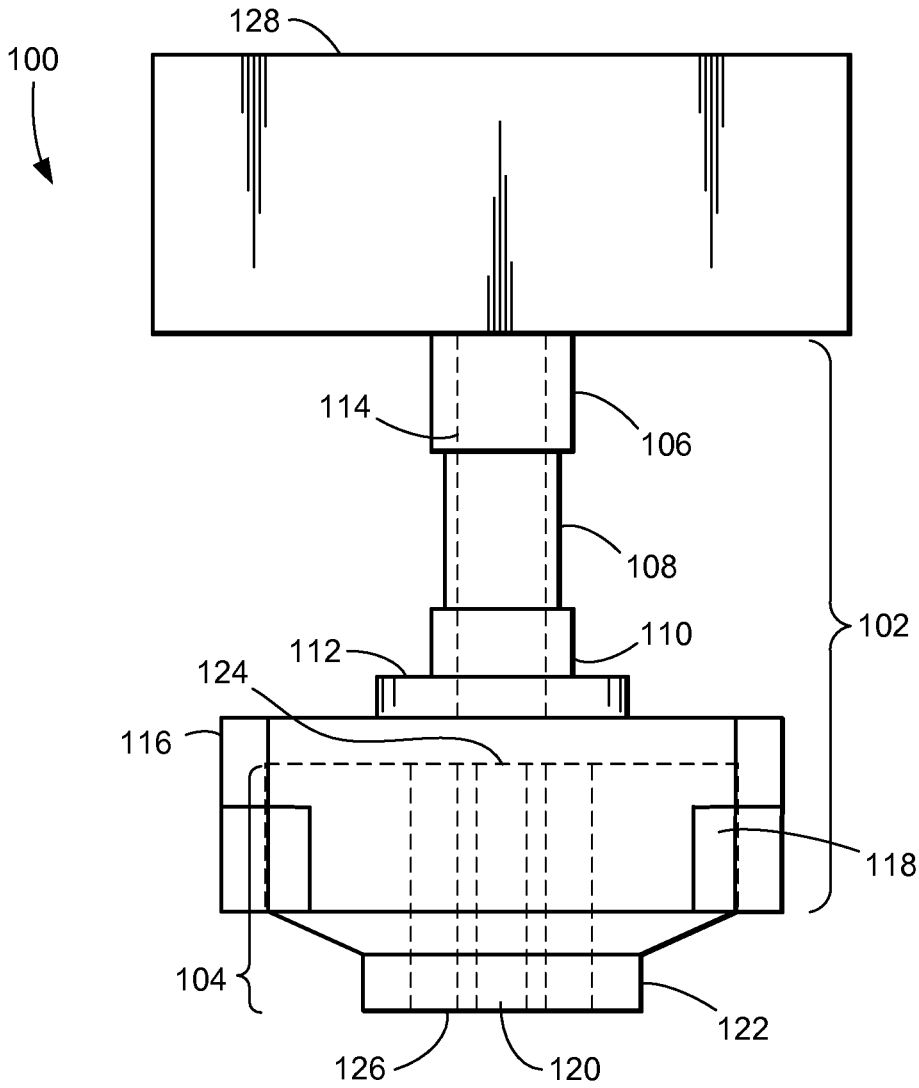
FIG. 1 is a side view of a workpiece displacement system in accordance with an embodiment of the present invention.

The following embodiments are described in sufficient detail to enable those skilled in the art to make and use the invention. It is to be understood that other embodiments would be evident based on the present disclosure, and that process or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known circuits, system configurations, and process steps are not disclosed in detail. Likewise, the drawings showing embodiments of the device are semi-diagrammatic and not to scale and, particularly, some of the dimensions are for the clarity of presentation and are shown exaggerated in the drawing FIGs.

Additionally, where multiple embodiments are disclosed and described having some features in common, for clarity and ease of illustration, description, and comprehension thereof, similar and like features one to another will ordinarily be described with like reference numerals.

The term "horizontal" as used herein is defined as a plane parallel to the plane or surface of the top surface of the force distribution member, regardless of its orientation. The term "vertical" refers to a direction perpendicular to the horizontal as just defined. Terms, such as "on", "above", "below", "bottom", "top", "side" (as in "sidewall"), "higher", "lower", "upper", "over", and "under", are defined with respect to the horizontal plane. The term "processing" as used herein includes deposition of material or photoresist, patterning, exposure, development, etching, cleaning, and/or removal of the material or photoresist as required in forming a described structure.

Referring now to FIG. 1, therein is shown a side view of a workpiece displacement system 100 in accordance with an embodiment of the present invention. By way of example, the workpiece displacement system 100 may function as a vacuum-bonding tool used for picking singulated semiconductors devices from a wafer and placing them onto another device and/or substrate.

Generally, the workpiece displacement system 100 may include two main components: a head 102 and a force distribution member 104. More specifically, the head 102 may include a top collar 106, a shaft 108, a bottom collar 110, a flange 112, a conduit 114 (shown in hidden outline), a recess port 116, and a notch(es) 118; and the force distribution member 104 may include an opening(s) 120 (shown in hidden outline) and a workpiece adhesion interface 122. The main body of the workpiece displacement system 100 is attached to the head 102 via the top collar 106. The main body is represented by a block 128.

During operation, the workpiece displacement system 100 exerts a negative pressure state upon a workpiece (not shown), such as a semiconductor device. The negative pressure state, such as a vacuum, creates a condition of adhesion between the workpiece and the workpiece displacement system 100, thereby allowing displacement of the workpiece.

More specifically, the vacuum exerted by a pump of the workpiece displacement system 100 passes through the conduit 114, which cooperatively interfaces with first terminal ends 124 of the openings 120. Second terminal ends 126 of the openings 120, which terminate near the workpiece adhesion interface 122, distribute the vacuum evenly to an overall workpiece area.

Notably, the design of the force distribution member 104 allows the workpiece adhesion interface 122 to substantially mirror the size dimensions of the workpiece, and, consequently, allow strategic distribution of the openings 120, which promotes a uniform workpiece attach force. Furthermore, the surface area and/or size dimensions of the workpiece adhesion interface 122 can be modified to best accommodate the process requirements and size requirements of the workpiece to further promote a uniform workpiece attach force. By way of example, the uniform workpiece attach force exhibited by the present invention is especially useful for film adhesive applications.

Uniquely, the head 102, or more specifically the recess port 116, and the force distribution member 104 are adapted for cooperative engagement. The designs of the recess port 116 and the force distribution member 104 are such that when mated together a secure contact occurs between a surface of the recess port 116 and a surface of the force distribution member 104. Per this invention, a secure contact can be defined as the amount of adhesion strength necessary between adjacent surfaces that prevents processing failures due to separation of the surfaces during manufacturing operations. By way of example, the secure contact of the present invention helps to ensure a proper alignment between the recess port 116 and the force distribution member 104, thereby ensuring a uniform workpiece attach force, which can eliminate voids formed during film adhesive applications.

An additional aspect of the secure contact design of the present invention is the minimization of vacuum pressure losses due to leaks. By employing design tolerance limitations commensurate with the objectives of a secure contact, the present invention has not only enhanced the bond strength between the recess port 116 and the force distribution member 104 but has also mitigated vacuum pressure losses due to leaks.

As exemplary illustrations, the secure contact between the recess port 116 and the force distribution member 104 can be achieved by the negative pressure state within the workpiece displacement system 100 and/or the design tolerance limitations employed when manufacturing the recess port 116 and the force distribution member 104. Additionally, the secure contact between the recess port 116 and the force distribution member 104 can be achieved by forming the force distribution member 104 from a compliant material that is slightly larger than the dimensions of the recess port 116, thereby ensuring a secure contact due to the compression of the force distribution member 104 upon insertion into the recess port 116.

Figure 2:
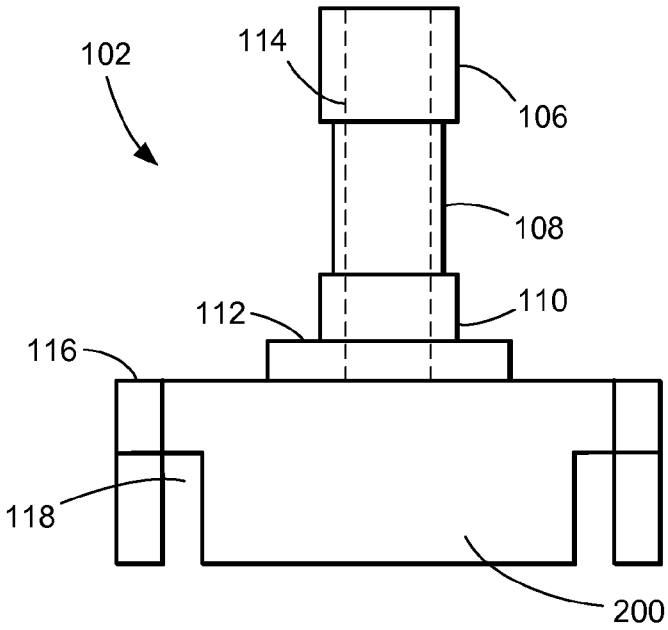
FIG. 2 is a side view of a head in accordance with an embodiment of the present invention.

Referring now to FIG. 2, therein is shown a side view of the head 102 in accordance with an embodiment of the present invention. The head 102 includes the top collar 106, the shaft 108, the bottom collar 110, the flange 112, the conduit 114 (shown in hidden outline), the recess port 116, the notches 118, and a wall(s) 200. The shaft 108 connects the top collar 106 to the bottom collar 110 while the conduit 114, which traverses the length of the major axis of the shaft 108, provides a passageway for a vacuum to the recess port 116.

The bottom collar 110 interfaces with the flange 112, which in turn is attached to the recess port 116. The recess port 116 includes the notch 118 and the wall 200. The recess port 116 is a hollowed out structure designed to receive the force distribution member 104, of FIG. 1. The notch 118 facilitates the insertion of the force distribution member 104 into the recess port 116 by reducing the amount of force needed to insert the force distribution member 104, while the wall 200 provides an additional retaining force to hold the force distribution member 104 in place after insertion.

Figure 3:
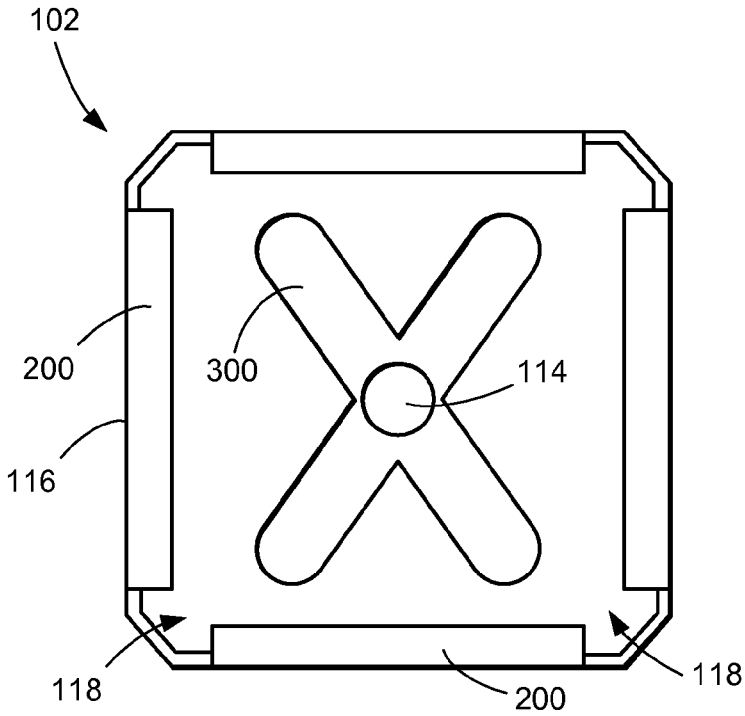
FIG. 3 is a bottom view of a head in accordance with an embodiment of the present invention.

Referring now to FIG. 3, therein is shown a bottom view of the head 102 in accordance with an embodiment of the present invention. This view of the head 102 depicts the recess port 116, the conduit 114, the notches 118, the walls 200, and a channel(s) 300. The channels 300 are grooves formed within the recess port 116. The channels 300 are designed to provide a cooperative interconnection between the conduit 114 and the openings 120, of FIG. 1. For example, in at least one embodiment, the major axis of the conduit 114 can be configured to intersect the recess port 116 and the channels 300, thereby permitting a cooperative interconnection between the conduit 114 and the openings 120. Per this invention, a cooperative interconnection is defined as an interface that minimizes or avoids altogether air leakage when a negative pressure state is applied to the workpiece displacement system 100. Generally, the channels 300 facilitate dispersion of the negative pressure state from the conduit 114 to the openings 120.

Although the channels 300 are depicted as an "X" configuration, it is to be understood that this configuration is merely representative and not limiting. In accordance with the scope of the present invention, the configuration of the channels 300 includes any pattern or design that permits a cooperative interconnection between the conduit 114 and the opening 120. Furthermore, although the recess port 116 is depicted as square in shape, it is to be understood that this design is merely representative and not limiting. In accordance with the scope of the present invention, the design of the recess port 116 includes any shape necessary that produces a cooperative interconnection and a secure contact between the force distribution member 104, of FIG. 1, and the recess port 116.

Figure 4:
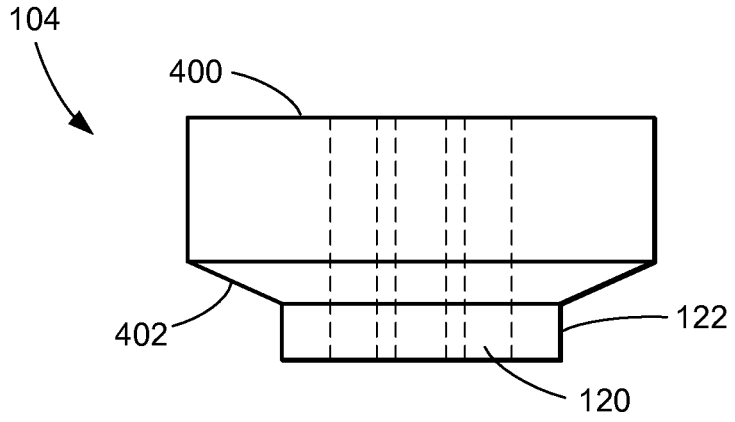
FIG. 4 is a side view of a force distribution member in accordance with an embodiment of the present invention.

Referring now to FIG. 4, therein is shown a side view of the force distribution member 104 in accordance with an embodiment of the present invention. The force distribution member 104 includes the openings 120, the workpiece adhesion interface 122, a top surface 400 and an angled sidewall(s) 402. The top surface 400 is larger than the workpiece adhesion interface 122 with the angled sidewalls 402 in-between. The openings 120 are strategically designed and configured to cooperatively interconnect with the channels 300, of FIG. 3. The openings 120 extend from the top surface 400 to the workpiece adhesion interface 122 and distribute the negative pressure state exerted by a vacuum pump of the main body of the workpiece displacement system 100, of FIG. 1.

The force distribution member 104 should be made from materials that can effectively abate and/or absorb impact forces generated during operation of the workpiece displacement system 100. The type of material chosen for the force distribution member 104 not only reduces the amount of forces imparted to a workpiece by the workpiece displacement system 100, but it also helps to ensure a secure contact, due to its pliable characteristics, between the workpiece adhesion interface 122 and an intended workpiece. As an exemplary illustration, the force distribution member 104 can be made from an elastic material, such as a polymer.

Notably, the design of the present invention helps to prevent wire touch failure that can occur during mounting of a top semiconductor die in a pyramid type die stack structure. The angled sidewalls 402 of the force distribution member 104 achieve this objective by providing additional clearance space between the force distribution member 104 and the electrical interconnections of a workpiece.

Furthermore, an additional notable aspect of the present invention is its simple design. The straightforward design of the force distribution member 104 produces an easily manufactured product that exhibits a low failure rate due to its simplicity.

Figure 5:
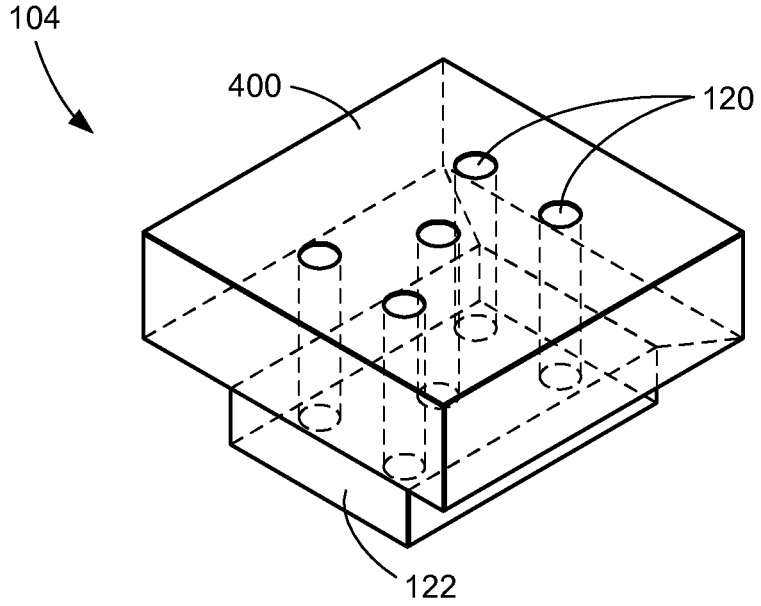
FIG. 5 is an isometric top view of a force distribution member in accordance with an embodiment of the present invention.

Referring now to FIG. 5, therein is shown an isometric top view of the force distribution member 104 in accordance with an embodiment of the present invention. The force distribution member 104 includes the openings 120, the workpiece adhesion interface 122, and the top surface 400. Per this embodiment the number, configuration and shape of the openings 120 is more clearly depicted. However, it is to be understood that the number (i.e.—five), configuration (i.e.—an "X" configuration) and shape (i.e.—circular) of the openings 120 is merely representative and these examples are not to be construed as limiting.

In accordance with the invention, a sufficient number (i.e.—one or more) of the openings 120 should be formed to adequately enable the workpiece displacement system 100, of FIG. 1, to pick up the intended workpiece. Furthermore, in accordance with the present invention, the configuration of the openings 120 includes any pattern or design that permits a cooperative interconnection between the openings 120 and the channels 300, of FIG. 3. Additionally, in accordance with the present invention, the shape of the openings 120 may include any design that effectively distributes the negative pressure state of the workpiece displacement system 100, such as circular, annular, square, rectangular, poly-sided, etc.

FIGS. 6-9 depict exemplary alternative embodiments of the workpiece displacement system 100, and are not to be construed as limiting. FIGS. 6-9 demonstrate the unique ability of the present invention to accommodate various workpiece sizes by only requiring modification of the force distribution member 104. By only requiring a modification to the force distribution member 104, without requiring a change to the head 102, the present inventors have discovered a time-saving retool modification step that will increase productivity output.

Figure 6:
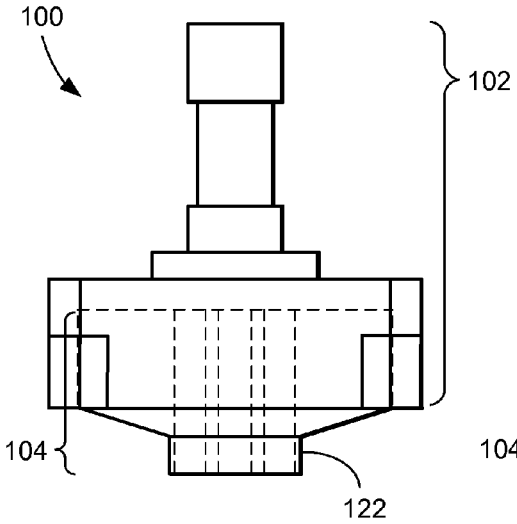
FIG. 6 is a side view of a portion of a workpiece displacement system in accordance with an embodiment of the present invention.

Referring now to FIG. 6, therein is shown a side view of a portion of the workpiece displacement system 100 in accordance with an embodiment of the present invention. Notably, this embodiment depicts the ability of the workpiece displacement system 100 to accommodate a particular workpiece size without having to modify or change the head 102. The only modification required of the workpiece displacement system 100, to accommodate the new workpiece size, is a retool of the workpiece adhesion interface 122 (i.e.—the force distribution member 104).

Figure 7:
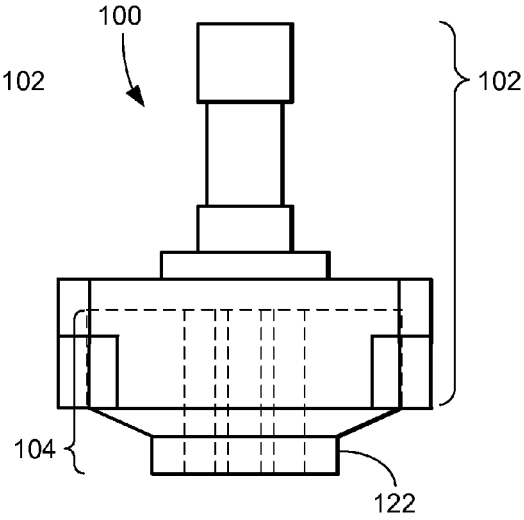
FIG. 7 is a side view of a portion of a workpiece displacement system in accordance with an embodiment of the present invention.

Referring now to FIG. 7, therein is shown a side view of a portion of the workpiece displacement system 100 in accordance with an embodiment of the present invention. Notably, this embodiment depicts the ability of the workpiece displacement system 100 to accommodate a particular workpiece size without having to modify or change the head 102. The only modification required of the workpiece displacement system 100, to accommodate the new workpiece size, is a retool of the workpiece adhesion interface 122 (i.e.—the force distribution member 104).

Figure 8:
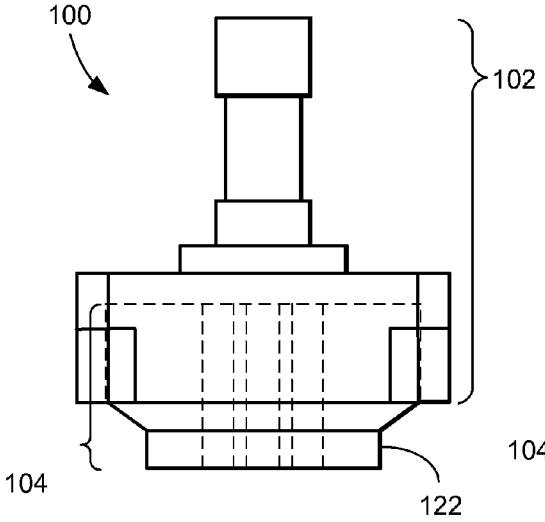
FIG. 8 is a side view of a portion of a workpiece displacement system in accordance with an embodiment of the present invention.

Referring now to FIG. 8, therein is shown a side view of a portion of the workpiece displacement system 100 in accordance with an embodiment of the present invention. Notably, this embodiment depicts the ability of the workpiece displacement system 100 to accommodate a particular workpiece size without having to modify or change the head 102. The only modification required of the workpiece displacement system 100, to accommodate the new workpiece size, is a retool of the workpiece adhesion interface 122 (i.e.—the force distribution member 104).

Figure 9:
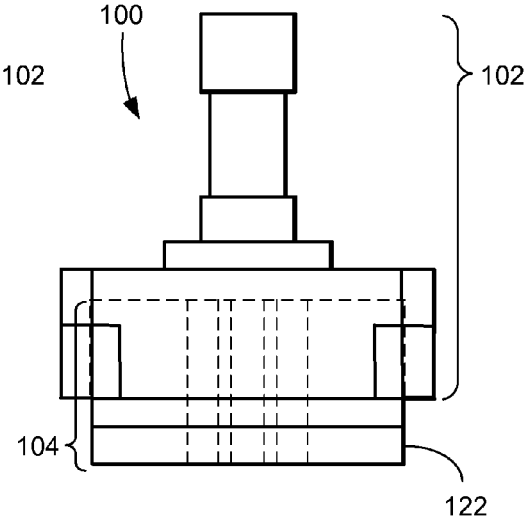
FIG. 9 is a side view of a portion of a workpiece displacement system in accordance with an embodiment of the present invention.

Referring now to FIG. 9, therein is shown a side view of a portion of the workpiece displacement system 100 in accordance with an embodiment of the present invention. Notably, this embodiment depicts the ability of the workpiece displacement system 100 to accommodate a particular workpiece size without having to modify or change the head 102. The only modification required of the workpiece displacement system 100, to accommodate the new workpiece size, is a retool of the workpiece adhesion interface 122 (i.e.—the force distribution member 104).

Figure 10:
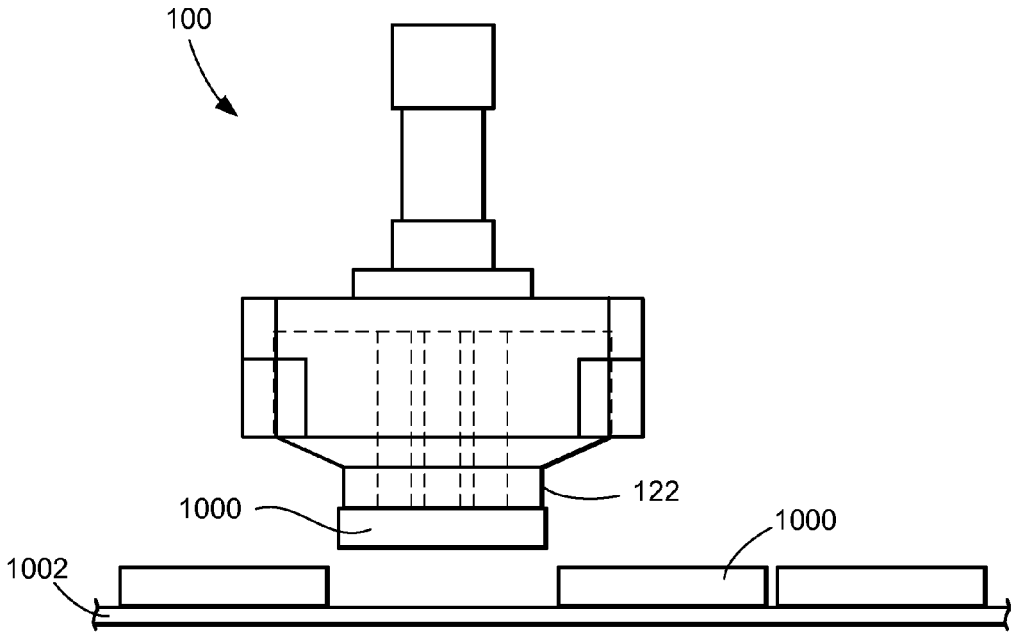
FIG. 10 is a side view of a portion of a workpiece displacement system during picking of a workpiece in accordance with an embodiment of the present invention.
Figure 11:
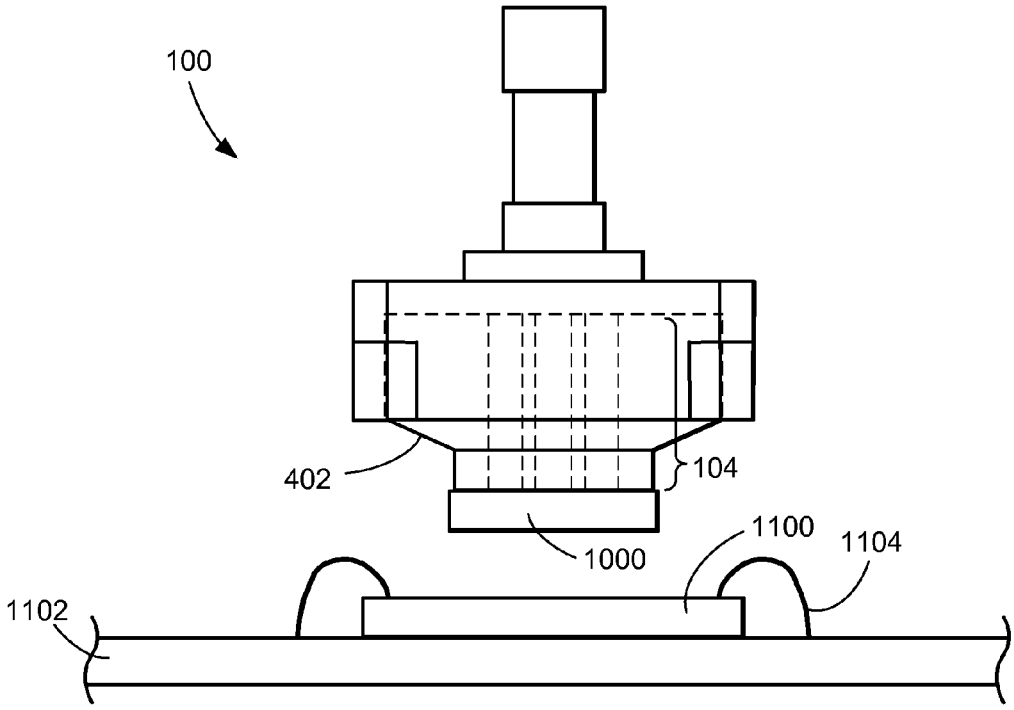
FIG. 11 is a side view of a portion of a workpiece displacement system during mounting of a workpiece in accordance with an embodiment of the present invention.

FIGS. 10-11 depict exemplary process applications and are not to be construed as limiting.

Referring now to FIG. 10, therein is shown a side view of a portion of the workpiece displacement system 100 during picking of a workpiece 1000 in accordance with an embodiment of the present invention. Generally, during operation of the workpiece displacement system 100, the negative pressure state generated within the workpiece displacement system 100 allows the workpiece adhesion interface 122 to engage the workpiece 1000 and pick it from a substrate 1002.

By way of example, the workpiece 1000 may include semiconductor chips and integrated circuit packages selected from active components, passive components, stacked components, power components, and so forth, in numerous configurations and arrangements as may be needed. It is to be understood that the workpiece 1000 covers a wide range of semiconductor chip and integrated circuit package configurations involving various sizes, dimensions, and electrical contact techniques, and the type of chip or package configuration employed should only be limited by the design specifications of the workpiece 1000.

As an exemplary illustration, the workpiece 1000 may include semiconductor package configurations, such as package-in-package (PiP) and package-on-package configurations (PoP). The PiP system is a 3D package system that stacks a fully tested Internal Stacking Module (ISM) on top of a Base Assemble Package (BAP) to form a single Chip Scale Package (CSP). PoP is a 3D package in which fully tested packages are stacked on top of another single or stacked package during the board mount process.

However, the workpiece 1000 is not to be limited to the above examples. In accordance with the scope of the present invention, the workpiece 1000 may include any article that is capable of being transported or displaced by the workpiece displacement system 100.

By way of example, the substrate 1002 may include an adhesive film. However, it is to be understood that the substrate 1002 is not limited to this example. In accordance with the scope of the present invention, the substrate 1002 may include any structure that provides support for the workpiece 1000.

Referring now to FIG. 11, therein is shown a side view of a portion of the workpiece displacement system 100 during mounting of the workpiece 1000 in accordance with an embodiment of the present invention. Generally, this embodiment depicts the mounting of the workpiece 1000 to a semiconductor chip 1100 that is electrically connected to a leadframe 1102 by wire bonds 1104. The design and shape of the force distribution member 104, notably the angled sidewalls 402, prevents the workpiece displacement system 100 from contacting the wire bonds 1104 and causing wire touch failure or damage.

Figure 12:
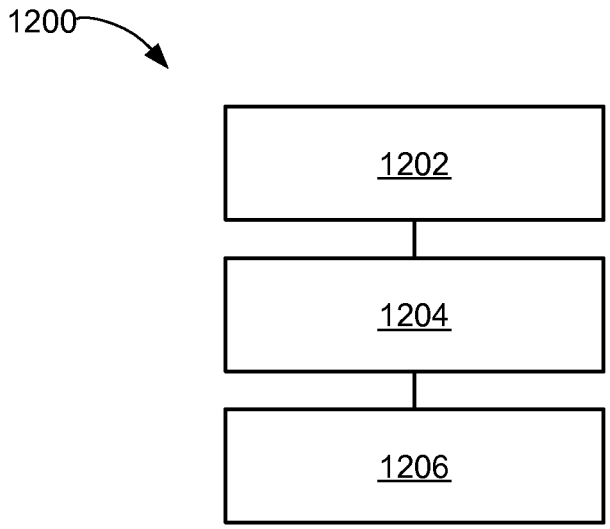
FIG. 12 is a flow chart of a workpiece displacement system for a workpiece displacement system in accordance with an embodiment of the present invention.

Referring now to FIG. 12, therein is shown a flow chart of a workpiece displacement system 1200 for the workpiece displacement system 100 in accordance with an embodiment of the present invention. The workpiece displacement system 1200 includes providing a head including a conduit, a recess port, and a channel, the conduit configured such that its major axis intersects the recess port and the channel in a block 1202; inserting a force distribution member into the recess port in a block 1204; and supplying a negative pressure state through the head and the force distribution member in a block 1206.

It has been discovered that the present invention thus has numerous aspects. A principle aspect of the present invention is its ability to reduce occurrences of failure due to loose adhesion between the head and the force distribution member. The present invention produces a secure contact between the head and the force distribution member that prevents separation during operation of the workpiece displacement system.

Another aspect of the present invention is its ability to promote a uniform workpiece attach force due to the design of the force distribution member. By designing the force distribution member to exhibit a uniform workpiece attach force, the occurrence of chip attach failure due to the formation of a void between the chip being placed and an underlying chip or substrate, can be avoided.

Yet another important aspect of the present invention is that the workpiece displacement system can be easily modified to accommodate various die sizes. By only requiring modification to the force distribution member to accommodate various die sizes, equipment retool time can be reduced and the number of units processed by the workpiece displacement system per hour can be increased.

Yet still, another important aspect of the present invention is that it prevents wire touch failure or damage that commonly occurs during top die attachment in pyramid type die stack structures. By incorporating a force distribution member with angled sidewalls, the present invention has eliminated the potential problem of wire bond damage that can occur during die stacking processes.

Yet still, another important aspect of the present invention is that it can be used in normal semiconductor package attach, such as PiP and PoP applications.

Yet another important aspect of the present invention is that it valuably supports and services the historical trend of reducing costs, simplifying systems, and increasing performance.

These and other valuable aspects of the present invention consequently further the state of the technology to at least the next level.

Thus, it has been discovered that the workpiece displacement system of the present invention furnishes important and heretofore unknown and unavailable solutions, capabilities, and functional aspects for workpiece adhesion problems, wire damage problems, and varying process die size accommodation problems. The resulting processes and configurations are straightforward, cost-effective, uncomplicated, highly versatile and effective, can be implemented by adapting known technologies, and are thus readily suited for efficiently and economically manufacturing integrated circuit devices.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations, which fall within the scope of the included claims. All matters hithertofore set forth herein or shown in the accompanying drawings are to be interpreted in an illustrative and non-limiting sense.

What is claimed is:

1. A method of operation of a workpiece displacement system comprising:

providing a head including a conduit, a recess port, and a channel, an end of the conduit directly connected with a side of the channel within the recess port;

inserting a force distribution member into the recess port, the force distribution member having a top surface section, a workpiece adhesion interface, and an angled sidewall section between the top surface section and the workpiece adhesion interface, wherein the surface area of the top surface section is larger than the surface area of the workpiece adhesion interface such that the force distribution member includes the larger top surface section tapering along the angled sidewall section into the smaller workpiece adhesion interface; and supplying a negative pressure state through the head and the force distribution member such that a workpiece is physically contacted once and only by the workpiece adhesion interface, the workpiece being a semiconductor die.

2. The method as claimed in claim 1 further comprising:

configuring the force distribution member to accommodate a particular workpiece size without having to modify or change the head.

3. The method as claimed in claim 1 further comprising:

configuring the force distribution member to prevent wire touch failure or damage.

4. The method as claimed in claim 1 further comprising:

configuring the recess port and the force distribution member to ensure a secure contact.

5. The method as claimed in claim 1 wherein:

supplying a negative pressure state allows the workpiece displacement system to pick up or mount the workpiece.

6. A method of operation of a workpiece displacement system comprising:

providing a head with a conduit, a recess port and a channel, an end of the conduit directly connected with a side of the channel within the recess port;

providing a force distribution member with an opening, the force distribution member having a top surface section, a workpiece adhesion interface, and an angled sidewall section between the to surface section and the workpiece adhesion interface, wherein the surface area of the top surface section is larger than the surface area of the workpiece adhesion interface such that the force distribution member includes the larger top surface section tapering along the angled sidewall section into the smaller workpiece adhesion interface; and configuring the head and the force distribution member to create a condition of adhesion between a workpiece and the workpiece displacement system so that the workpiece is physically engaged once and only by the workpiece adhesion interface, the workpiece being a semiconductor die.

7. The method as claimed in claim 6 wherein:

providing the force distribution member includes the force distribution member made from materials that can effectively abate or absorb impact forces.

8. The method as claimed in claim 6 wherein:

configuring the head and the force distribution member includes forming a secure contact between the recess port and the force distribution member.

9. The method as claimed in claim 6 further comprising:

configuring the recess port to include a notch and a wall.

10. The method as claimed in claim 6 further comprising:

configuring the channel to provide a cooperative interconnection between a conduit and the opening.

11. A workpiece displacement system comprising:

a head including a conduit, a recess port, and a channel, an end of the conduit directly connected with a side of the channel within the recess port; and a force distribution member within the recess port, the force distribution member having a top surface section, a workpiece adhesion interface, and an angled sidewall section between the top surface section and the workpiece adhesion interface, wherein the surface area of the top surface section is larger than the surface area of the workpiece adhesion interface such that the force distribution member includes the larger top surface section tapering along the angled sidewall section into the smaller workpiece adhesion interface, wherein only the workpiece adhesion interface is configured to come into physical contact with a workpiece, and wherein the workpiece adhesion interface need only engage the workpiece once, the workpiece being a semiconductor die.

12. The system as claimed in claim 11 wherein:

the force distribution member includes an opening.

13. The system as claimed in claim 11 wherein:

the force distribution member prevents wire touch failure or damage.

14. The system as claimed in claim 11 wherein:

the force distribution member is made from a material that can effectively abate or absorb impact forces.

15. The system as claimed in claim 11 wherein:

the workpiece adhesion interface accommodates a particular workpiece size.

16. The system as claimed in claim 11 wherein:

the recess port includes a notch and a wall.

17. The system as claimed in claim 11 wherein:

the channel provides a cooperative interconnection between the conduit and an opening.

18. The system as claimed in claim 11 wherein:

the channel facilitates dispersion of a negative pressure state from the conduit to an opening.

19. The system as claimed in claim 11 wherein:

the head and the force distribution member are bound by a secure contact.

* * * * *